US005878870A

United States Patent [19]

Ohtaki

[11] Patent Number: 5,878,870

[45] Date of Patent: Mar. 9, 1999

[54] ILLUMINATION DEVICE FOR A KNOB OF A SWITCH

[75] Inventor: Kazue Ohtaki, Tokyo, Japan

[73] Assignee: Niles Parts Co., Ltd., Japan

[21] Appl. No.: 864,364

[22] Filed: May 28, 1997

[30] Foreign Application Priority Data

May 29, 1996 [JP] Japan ..... 8-156390

[51] Int. Cl.[6] ..... H01H 9/00

[52] U.S. Cl. ..... 200/314; 200/313

[58] Field of Search ..... 200/314, 313, 200/310, 308, 311, 312, 520, 341, 315, 316

[56] References Cited

U.S. PATENT DOCUMENTS

| | | | |
|---|---|---|---|
| 3,594,528 | 7/1971 | Viau | 200/314 |
| 4,683,359 | 7/1987 | Wojtanek | 200/314 |
| 4,933,523 | 6/1990 | Honda et al. | 200/314 |
| 5,120,920 | 6/1992 | Moriike | 200/313 |
| 5,651,450 | 7/1997 | Priesemuth | 200/314 |

FOREIGN PATENT DOCUMENTS

| | | |
|---|---|---|
| 4-72519 | 6/1992 | Japan . |
| 6-62438 | 9/1994 | Japan . |

*Primary Examiner*—David J. Walczak
*Attorney, Agent, or Firm*—Ronald P. Kananen; Rader, Fishman & Grauer

[57] ABSTRACT

A movable member 4 is slidably mounted within a space 3 formed by a first fix member 1 and a second fix member 2 composing a case. The movable member 4 is made of a white type resin, such as polyacetal, and composed of a column-shaped extended section 4*a* extending frontwardly for being pulled from and inserted into the space 3, a bottom wall 4*h* and side walls 4*d*, 4*d* extending from the extended a section 4*a* rearwardly, and a rear wall 4*p* coupled with the bottom wall 4*h* and the side walls 4*d*, 4*d*. The extended section 4*a* is fixed with a knob 5. The second fix member 2 forms a lamp base 2*c* loading light sources 9 and 10. A displaying section 5*b*, such as a display mark and characters, is provided on the knob 5, and a displaying member 15 made of a transparent resin with white color, such as a heat-resistance acrylic, is embedded in the displaying section 5*b* at the back surface of the knob 5. The knob 5 has a column-shaped section 15*a* extending until the portion adjacent to contact holes 5*a*, wherein the end point of the extended section 4*a* of the movable member 4 is contacted to the end point of the column-shaped section 15*a* when the movable member 4 is assembled. According to the present invention, there is presented an illumination device for illuminating the knob of a switch which provides easy observation of the displaying section, a sufficient luminance, less expense, and good productivity.

2 Claims, 2 Drawing Sheets

ILLUMINATION DEVICE FOR A KNOB OF A SWITCH

BACKGROUND OF THE INVENTION

1. Field of the Invention

Figure 1:
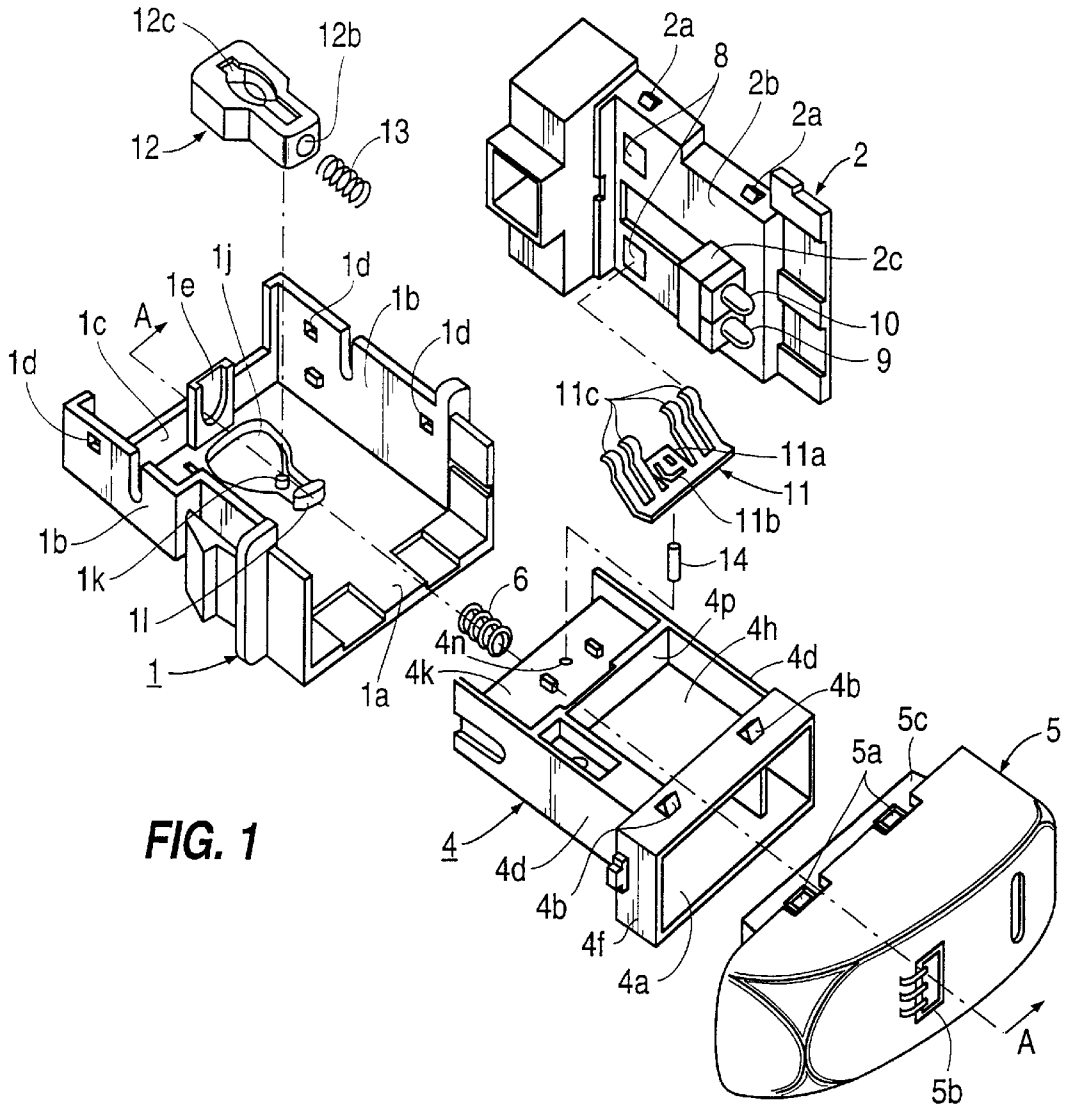

The present invention relates generally to automotive switches and, in particular, to an illumination device for illuminating the knob of a switch, such as a hazard switch or a rear-defogger switch of an automobile.

2. Description of the Prior Art

A conventional illumination device for illuminating the knob of switches is disclosed, for example, in Japanese Utility Model Publication Laid-Open No. 4-72519. The conventional illumination device includes an illuminating section which is mounted on a knob, and a light source which is mounted at the back surface of the knob. In the conventional illumination device, the luminance of the illuminating section was sometimes insufficient, because the light source is surrounded by rubber material or a resin member with black color, thereby utilizing only directly emitted light beams for the purpose of illuminating the knob, although a transparent material is used for the illuminating section.

Another conventional illumination device is disclosed in Japanese Utility Model Publication Laid-Open No. 6-62438. In this conventional illumination device, a light source is disposed at the back side of a push switch, and there is mounted a hollow-shaped reflector surrounding the light source fixed on the knob, in order to provide a sufficient luminance.

According to the above-mentioned conventional devices, even though sufficient luminance may be obtained by providing such reflectors, the devices undesirably require more expense and result in poor productivity because of the necessity of providing such reflectors.

SUMMARY OF THE INVENTION

The object of the present invention is to present an illumination device for illuminating the knob of a switch in which there are presented an observation of the illuminating section with a sufficient luminance, less expense, and good productivity.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

In order to achieve the above objects and advantages of the present invention, an illumination device for the knob of a switch is provided comprising: a case, a light source supported within the case, a movable member slidably mounted within the case, and a knob attached on the movable member, wherein there are provided a displaying section on a surface of the knob, and a displaying member made of a transparent resin with white type color embedded in the displaying section and extending rearwardly from the back surface of the knob, and the movable member is made of white type resin.

The invention further features a structure wherein the movable member has a column-shaped extended section extending to the front of the light source, and the knob is attached to the extended section.

The invention further features a structure wherein the movable member is composed of a bottom wall and the walls extending from the extended section rearwardly, and a rear wall coupled with the bottom wall and the side walls, thereby forming a reception space for the light source.

The invention further features a structure wherein the portion of the case for supporting the light source is made of a white type resin.

The invention further features a structure wherein the displaying member extends to the end point of the extending section of the movable member with a column shape.

BRIEF DESCRIPTION THE DRAWINGS

Figure 2:
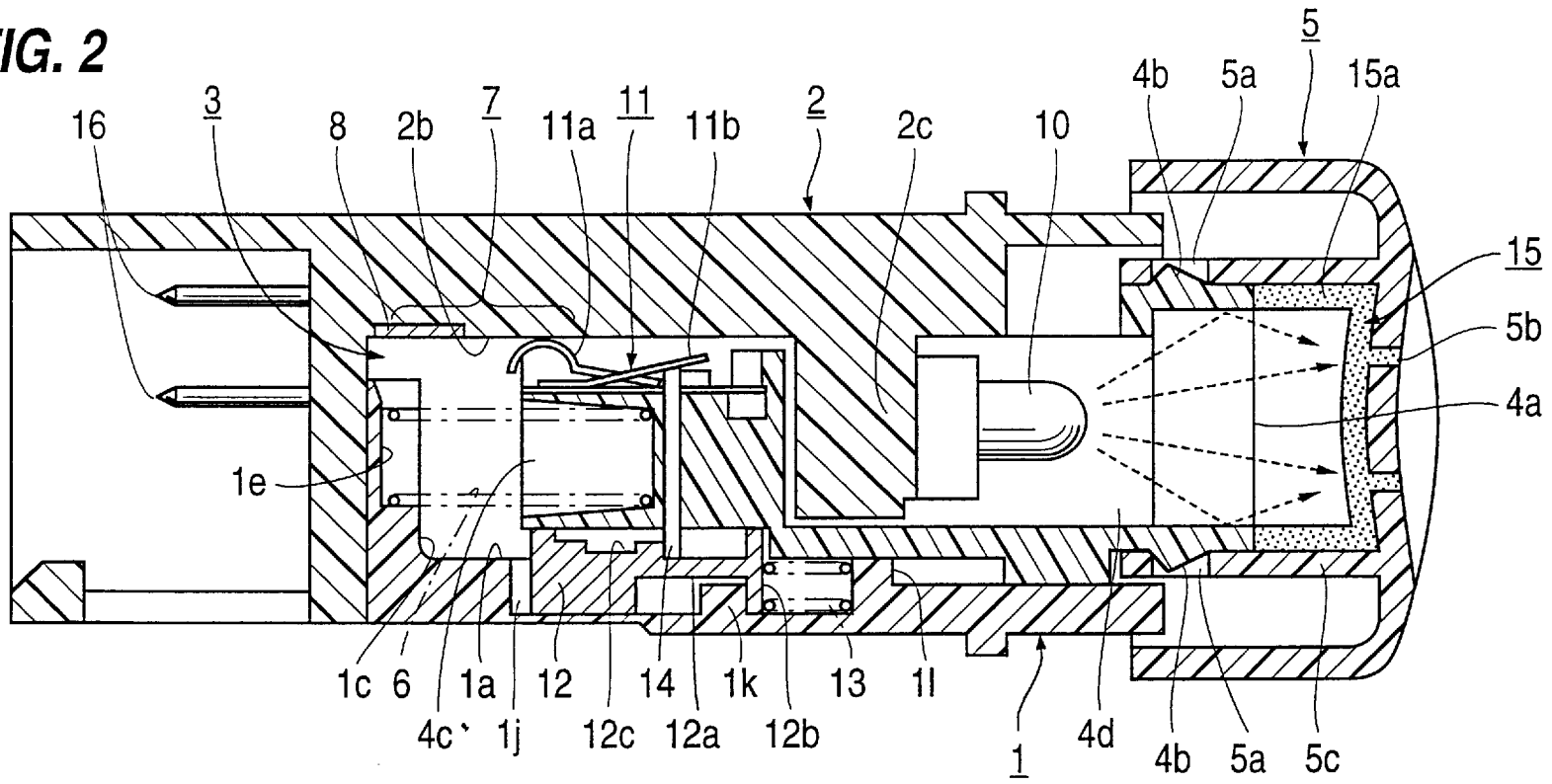

The present invention will become more clearly appreciated as the disclosure of the invention is made with reference to the accompanying drawings. In the drawings:

FIG. 1 is an exploded perspective view showing a switch having an illumination device according to a preferred embodiment of the present invention; and FIG. 2 is a sectional view taken along the line A—A in FIG. 1.

PREFERRED EMBODIMENT OF THE PRESENT INVENTION

An illumination device for a knob of a switch according to a preferred embodiment of the present invention will now be described with reference to FIGS. 1 and 2 of the drawings.

A first fix member 1 is provided for performing the function as a case. The first fix member 1 is formed of a resin material, such as ABS with black color. The first fix member 1 is formed in an upper opened shape, in section, composed of a bottom wall 1*a* and both side walls 1*b*. Moreover, a rear wall 1*c* is formed in a body together with the bottom wall 1*a* and side walls 1*b* at one end of the first fix member 1. Four contact holes id are provided at the upper end of each of the side walls 1*b*.

A second fix member 2 is also provided for performing the function as a case. The second fix member 2 is provided with four contact projections 2*a*. By fitting the four contact projections 2*a* of the second fix member 2 with the four contact holes 1*d*, respectively, the first fix member 1 is coupled with the second fix member 2, thereby forming a space 3.

A movable member 4 adapted to perform a slidable movement is received within the space 3 formed by the first and the second fix members 1, 2. The movable member 4 is made of resin, such as white polyacetal, and formed integrally with a column-shaped extended section 4*a* adapted to be movable forwardly and backwardly with respect to the space 3. The movable member 4 has a bottom wall 4*h* extending rearwardly, side walls 4*d* and 4*d*, and a rear wall 4*p* coupled with the bottom wall 4*h* and side walls 4*d* and 4*d*, thereby forming a reception space for a light source, as described below. The extended section 4*a* is provided with contact projections 4*b* at its upper and lower surfaces. A knob 5 is adapted to be coupled with the extended section 4*a* by fitting the contact projections 4*b* with contact holes 5*a* mounted on the knob 5, respectively. The movable member 4 is actuated toward the extended section 4*a* by using a coil spring 6 mounted between a hole 4*c* formed on the other end of the movable member 4 and a base 1*e* formed on the rear wall 1*c* of the first fix member 1.

The second fix member 2 is made of resin, such as nylon with black color. The second fix member 2 is provided with fixed contacts 8 on the inner wall surface 2*b* to be opposite to the movable member 4. The second fix member 2 is also provided with a lamp base 2*c* on which a lamp 9 as a light source, for displaying the switch which has been actuated, and a lamp 10 for a night illumination are mounted. The illumination light from the lamps 9 and 10 is illuminated through the knob 5. The fixed contacts 8 are adapted to be connected to external terminals 16 mounted at one end of the second fix member 2. On the movable member 4, there is fixed a movable contact 11 (described below) at the back side of the lamp base 2*c*.

The movable contact 11 is made of a resilient conductive plate member, and provided with a first contact piece 11*a* extending along the upper surface 4*k* of the movable member 4 at the central portion of the one end side, and a second contact piece 11*c* disposed at both sides of the first contact piece 11*a* to contact the fixed contacts 8. Moreover, there is provided a pressing section 11*b* extending from its end point to the base side of the first contact piece 11*a*. Thus, a switch section 7 is constructed by the fixed contact 8 mounted on the second fix member 2 and the movable contact 11 fixed on the movable member 4.

A recess section 1*j* is provided at the inner surface of the bottom wall 1*a* of the first fix member 1. The recess section 1*j* has a supporting shaft 1*k* at its one side and is adapted to fit with a contact groove 12*a* formed at the back surface of a heart cam 12. By this structure, the heart cam 12 is swingably supported within the recess section 1*j* by the supporting shaft 1*k* and movable in the direction of movement of the movable member 4. The heart cam 12 is actuated toward the rear wall 1*c* side by the resilient force of a coil spring 13 mounted between the spring receiver 1*l* projected from the inner surface of the bottom wall 1*a* of the first fix member 1 and the recess formed on the movable side 12*b* of the heart cam 12.

The heart cam 12 has a cam groove 12*c* with a predetermined shape on the surface opposite to the movable member 4. The cam groove 12*c* composes a push lock mechanism together with a lock pin 14 inserted into a pin hole 4*n* formed on the movable member 4. The other end of the lock pin 14 is actuated toward the heart cam side 12 by the pressing section 11*b* of the movable contact 11.

The knob 5 is made of resin, such as ABS with the black type color, and has a displaying section 5*b* on the surface of which a mark, a character, or the like is provided. Moreover, there is formed integrally a column-shaped section 5*c* extending rearwardly from the back surface of the knob 5, which surrounds the displaying section 5*b*. Contact holes 5*a* are formed at the adjacent portion of the column-shaped section 5*c* for fitting the contact projections 4*b* formed on the extended section 4*a* of the movable member 4.

On the back surface of the knob 5, a displaying member 15 made of resin, such as a heat-resistance acrylic resin or polycarbonate resin with transparent white color, is embedded within the displaying section 5*b*. A column shaped section 15*a* is provided extending along with the inner surface of the column-shaped section 5*c* until the adjacent portion of the contact holes 5*a*. In the state that the knob 5 is attached to the movable member 4, the end point of the extended section 4*a* of the movable member 4 is contacted with the end point of the column-shaped section 15*a*.

In assembling the switch of the present invention, as shown in FIG. 1, first the supporting shaft 1*k* of the first fix member 1 is fitted to the contact groove 12*a* of the heart cam 12, and the coil spring 13 is mounted between the spring receiver 1 and the end surface 12*b* of the heart cam 12. Moreover, the movable member 4 mounted with the coil spring 6 received in the hole 4*c*, is moved downwardly toward the bottom wall 1*a* from the upper portion of the first fix member 1, and then is put on the bottom wall 1*a*. Then, the lock pin 14 is inserted into the pin hole 4*n*, thereby mounting the movable contact 11 on the upper surface 4*k* of the movable member 4. Next, the second fix member 2 is pressed down to the first fix member 1 until the contact projections 2*a* are fitted to the contact holes 1*d*. Moreover, the knob 5 is mounted on the movable member 4 by mounting the contact projections 4*b* to the contact holes 5*a*, thereby completing the assembling of the switch mechanism.

As mentioned above, when the switch is assembled, the front side of the lamp 10 for night illumination is covered with the extended section 4*a* of the movable member 4 in a column-shaped fashion. The front side of the lamp 10 is further covered up to the back surface of the knob 5 by the column-shaped section 15*a* of the displaying member 15 fixed on the knob 5. Since the movable member 4 and the displaying member 15 are formed by using white type resin material, the illumination light from the actuated lamp 10 is reflected by respective surfaces and radiated outside from the displaying section 5*b* of the knob 5 together with direct beams therefrom.

In operation of the switch mechanism of the present invention, in the state of the movable member 4 shown in FIG. 2, since the movable contact pieces 11*c* are apart from the fixed contacts 8, the switch section 7 is in the state of OFF. Upon pressing of the knob 5 from the above state, the movable member 4 is slidably moved against the resilient force of the coil spring 6 and, therefore, the movable contact pieces 11*c* are electrically connected to the fixed contacts 8, thereby actuating the switch section 7 to ON state. At this time, the heart cam 12 is driven by the rock pin 14 and moved on the basis of the supporting shaft 1*k*. When the rock pin 14 is in the condition of contacting with the cam groove 12*c*, the movable member 4 maintains its pressed condition. Then, when the knob 5 is pressed again, the rock pin 14 is released from the cam groove 12*c*, and the movable member 4 is automatically restored to the state of FIG. 2 due to the resilient force of the coil spring 6, thereby making the switch section 7 OFF again.

According to the structure of the above-mentioned embodiment, the end point of the column-shaped section 15*a* of the displaying member 15 is contacted with the end point of the extended section 4*a* of the movable member 4. However, it is not necessary to contact with each other. Rather, both members may be apart with each other within the range in which a necessary amount of reflected light is maintained.

Moreover, in the above-mentioned embodiment the movable member 4 and the displaying member are made of resin of the white type. If the second fix member is also formed with resin of the white type, the light source could be surrounded by the white type member and, therefore, the illumination light from the light source is more effectively utilized. By the way, the white type color is not limited to a pure white color, but it may include a white color in which black or other colors is mixed.

As described above, the invention provides an illumination device for the knob of a switch comprising a case, a light source supported within the case, a movable member slidably mounted within the case, and a knob attached on the movable member, wherein there are provided a displaying section on a surface of the knob, and a displaying member made of a transparent resin with white type color embedded in the displaying section and extending rearwardly from the back surface of the knob, and the movable member is made of white type resin. With this structure, the illumination light from the light source is reflected by the surfaces of the movable member and the displaying member, thereby enabling an illumination for a whole of the displaying section with no irregularity and with sufficient luminance.

Since the invention also has the structure wherein the movable member has a column-shaped extended section extending to the front of the light source, and the knob is attached to the extended section, the illumination light radiated to the front of the light source is reliably reflected on the extended section, thereby enabling an effective utilization of the illumination light from the light source with more brilliant illumination for the displaying section.

Moreover, since the invention has the structure that the movable member is composed of a bottom wall and the walls extending from the extended section rearwardly, and a rear wall coupled with the bottom wall and the side walls, thereby forming a reception space for the light source, the light from the light source can be reflected by each of the wall surfaces of the movable member, thereby ensuring sufficient reflected light.

Since the invention also has the structure that the portion of the case for supporting the light source is made of a white type resin, all of the illumination light from the light source is effectively utilized.

Finally, since the invention has the structure that the displaying member extends until the end point of the extending section of the movable member with a column shape, the illumination light from the light source is continuously reflected within the knob by the movable member through the displaying member, thereby obtaining an effective illumination due to the light source without any attenuation of reflected light due to discontinuous reflecting surfaces.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

What is claimed is:

1. An illumination device for illuminating a knob of a switch, comprising:

a case;

a light source supported within said case;

a movable member made of white type resin slidably mounted within said case, said movable member having a column-shaped section extending in front of said light source and a plurality of walls defining a reception space behind said column-shaped section for accommodating said light source, said movable member being movable relative to said case and said light source for actuating the switch;

a knob attached to said column-shaped section of said movable member, said knob having a front surface and a back surface; and a displaying member made of a transparent resin with white type color, a front portion of said displaying member being embedded in said knob to form a displaying section on the front surface of the knob, said displaying member having a column-shaped section extending rearwardly from the back surface of said knob toward said movable member, and a rear end of said column-shaped section of the displaying member contacting a front end of said column-shaped section of the movable member, whereby light from said light source is directed by the white type resin of the movable member and the displaying member toward said displaying section.

2. The illumination device according to claim 1, wherein said case comprises two members attached together, and one of said members supports said light source and is made of a white type resin material.

* * * * *